US005884507A

United States Patent [19]

Lee et al.

[11] Patent Number: 5,884,507

[45] Date of Patent: Mar. 23, 1999

[54] CLOTHES WASHING MACHINE HAVING DRIVE TRANSMISSION WITH MESHABLE GEARS

[75] Inventors: Min Soo Lee, Uiwang; Hwan-Young Choi, Anyang, both of Rep. of Korea

[73] Assignee: Samsung Electronics Co., Ltd., Suwon, Rep. of Korea

[21] Appl. No.: 995,935

[22] Filed: Dec. 22, 1997

[30] Foreign Application Priority Data

Feb. 26, 1997 [KR] Rep. of Korea ..... 1997-6029

[51] Int. Cl.[6] ..... D06F 23/04; D06F 37/40

[52] U.S. Cl. ..... 68/23.7

[58] Field of Search ..... 68/23.7

[56] References Cited

U.S. PATENT DOCUMENTS 2,609,697 9/1952 Ruscoe ..... 68/23.7 X
2,699,682 1/1955 Castner ..... 68/23.7 X
5,172,573 12/1992 Sharp et al. ..... 68/23.7
5,586,455 12/1996 Imai et al. ..... 68/23.7 X

*Primary Examiner*—Philip R. Coe
*Attorney, Agent, or Firm*—Burns, Doane, Swecker & Mathis, L.L.P.

[57] ABSTRACT

A washing machine includes a water tub, a spin basket mounted inside the water tub, and a pulsator mounted in the spin basket. A drive transmission includes a hollow dehydrating shaft and a laundering shaft disposed coaxially therein. The hollow dehydrating shaft is connected to the spin basket, and the laundering shaft is connected to the pulsator. A connecting gear is mounted on the dehydrating shaft for vertical movement therealong. In an upper position, the connecting gear meshes with fixed teeth to prevent the spin basket from rotating. In a lower position, the connecting gear causes the laundering shaft and dehydrating shaft to be interconnected for common rotation. The connecting gear is rotatable slightly relative to the laundering shaft to accommodate meshing of gear teeth in response to upper and lower movement of the connecting gear. Springs are provided which act between the dehydrating shaft and the connecting gear and which are yieldable to permit the slight rotation of the connecting gear.

6 Claims, 7 Drawing Sheets

14

CLOTHES WASHING MACHINE HAVING DRIVE TRANSMISSION WITH MESHABLE GEARS

BACKGROUND OF THE INVENTION

1) Field of the Invention

The present invention relates to a power system of a clothes washing machine and, more particularly, to a power system of a washing machine which can suppress the rotation of a spin basket during a washing operation and rotate the spin basket at a high speed during a spin drying operation.

2) Description of the Related Art

Generally, a washing machine includes a main body defining an outer configuration thereof, a water tub installed within the body, and a spin basket and a pulsator mounted within the water tub. A power system for driving the spin basket and pulsator is mounted under the water tub.

The power system conventionally comprises a motor, a power transmission system, and a belt for connecting the motor to the power transmission system. This will be described hereinbelow with reference to FIG. 7.

As shown in FIG. 1, a conventional power system comprises a power transmission system 100 and a driving motor (not shown). The power transmission system 100 has a hollow dehydrating shaft 101 (so-called because it rotates the spin basket), and a laundering shaft 102 (so-called because it operates the pulsator) inserted into the hollow portion of the hollow dehydrating shaft 101. The laundering shaft 102 is divided into upper and lower portions, with a planetary gear unit 103 being disposed therebetween. The planetary gear unit 103 shifts between different rotating speeds. A brake band 104 and a brake lever 105 are disposed beside the dehydrating shaft 101 so as to brake rotation of the dehydrating shaft 101 during washing and rinsing stages. A one-way bearing 106, allowing the dehydrating shaft 101 to rotate in only one direction, is mounted on an outer circumference of the dehydrating shaft 101. In addition, a clutch spring 107 and a clutch lever 108 for transmitting/interrupting power from the motor to both the dehydrating shaft 101 and the laundering shaft 102 are mounted under the one-way bearing 106. A pulley 109 on which a belt (not shown) is engaged is mounted on a lower end of the laundering shaft 102.

In this conventional power transmission system 100, torque of the motor is selectively transmitted via shaft 102 to the pulsator 111 or via shaft 101 to the spin basket 110 by means of the clutch spring 107, thereby performing the washing and dehydrating operations. To achieve this, it is necessary that the clutch spring 107 has a high tensile strength to permit or interrupt the transmission of torque from the motor to the dehydrating shaft 101 and the laundering shaft 102, both of which are rotated at a high speed. However, the manufacturing process for such a spring having high tensile strength is complicated, and, as a result, manufacturing costs are increased.

In addition, the brake band 104 for preventing the spin basket 110 from idling (rotating) during the washing operation is, when it brakes the spin basket 110 in one direction, subjected to high resistance against force generated when the spin basket 110 is exerting force to rotate in an opposite direction by a water current within the water reserving basket. The above described one-way bearing 16 must thus be used, making the structure complicated and increasing manufacturing costs. Finally, an unpleasant noise is generated during the braking operation of the brake band.

As described above, the conventional power system of a washing machine is complicated with regard to the arrangement of parts for performing the washing, dehydrating and braking operations, making it difficult to manufacture the same and increasing manufacturing costs. In addition, because of the large number of parts needed for this complicated arrangement, much space is required which, in turn, acts to increase the overall size of the washer.

SUMMARY OF THE INVENTION

Therefore, the present invention is made in an effort to solve the above described problems.

It is an object of the present invention to provide a power system which is simple in structure while suppressing idling rotation of the spin basket.

It is another object of the present invention to provide a power system having a plurality of gears that can easily mesh with each other.

To achieve the above objects, the present invention provides a washing machine comprising a water tub for containing water; a spin basket mounted inside the water tub; a pulsator mounted in the spin basket; and a hollow dehydrating shaft having an upper end coupled to the spin basket and a lower end extending outside the water tub. The hollow dehydrating shaft has guide grooves extending longitudinally in a peripheral surface thereof. A laundering shaft is disposed coaxially within the hollow dehydrating shaft such that the laundering shaft extends out of the upper and lower ends of the hollow dehydrating shaft. A toothed coupling gear is coupled to the laundering shaft so as to rotate therewith. A toothed connecting gear is mounted on the dehydrating shaft to be ascendable/descendable along a longitudinal axis of the dehydrating shaft. The connecting gear has first teeth meshing with fixed teeth when the connecting gear is in an upper position, to prevent rotation of the spin basket. The connecting gear has second teeth meshing with teeth of the coupling gear when the connecting gear is in a lower position, to interconnect the laundering shaft and dehydrating shaft for common rotation. A raising/lowering mechanism is provided for raising and lowering the connecting gear between the upper and lower positions. The connecting gear carries guide projections that are slidable vertically within the guide grooves of the dehydrating shaft. A circumferential width of each guide groove is greater than a circumferential width of the associated guide projection to permit limited circumferential movement of the connecting gear relative to the dehydrating shaft for facilitating meshing of the first and second teeth of the connecting gear with the fixed teeth and the teeth of the coupling gear, respectively. Springs are arranged to act circumferentially between each guide projection and its respective guide groove and are yieldable to permit the circumferential movement of the connecting gear relative to the dehydrating shaft during the meshing of gear teeth.

The springs are preferably fastened to the connecting gear, and each spring preferably comprises a circumferentially extending coil spring.

Each guide groove preferably includes two longitudinally extending, circumferentially facing side walls. Opposite ends of each spring engage respective side walls of a respective guide groove.

The washing machine further includes a supporting plate attached to the connecting gear for fixing all of the springs to the connecting gear.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF A PREFERRED EMBODIMENT OF THE INVENTION

Reference will now be made in detail to a preferred embodiment of the invention illustrated in the accompanying drawings. Wherever possible, the same reference numbers will be used throughout the drawings to refer to the same or like parts.

Figure 1:
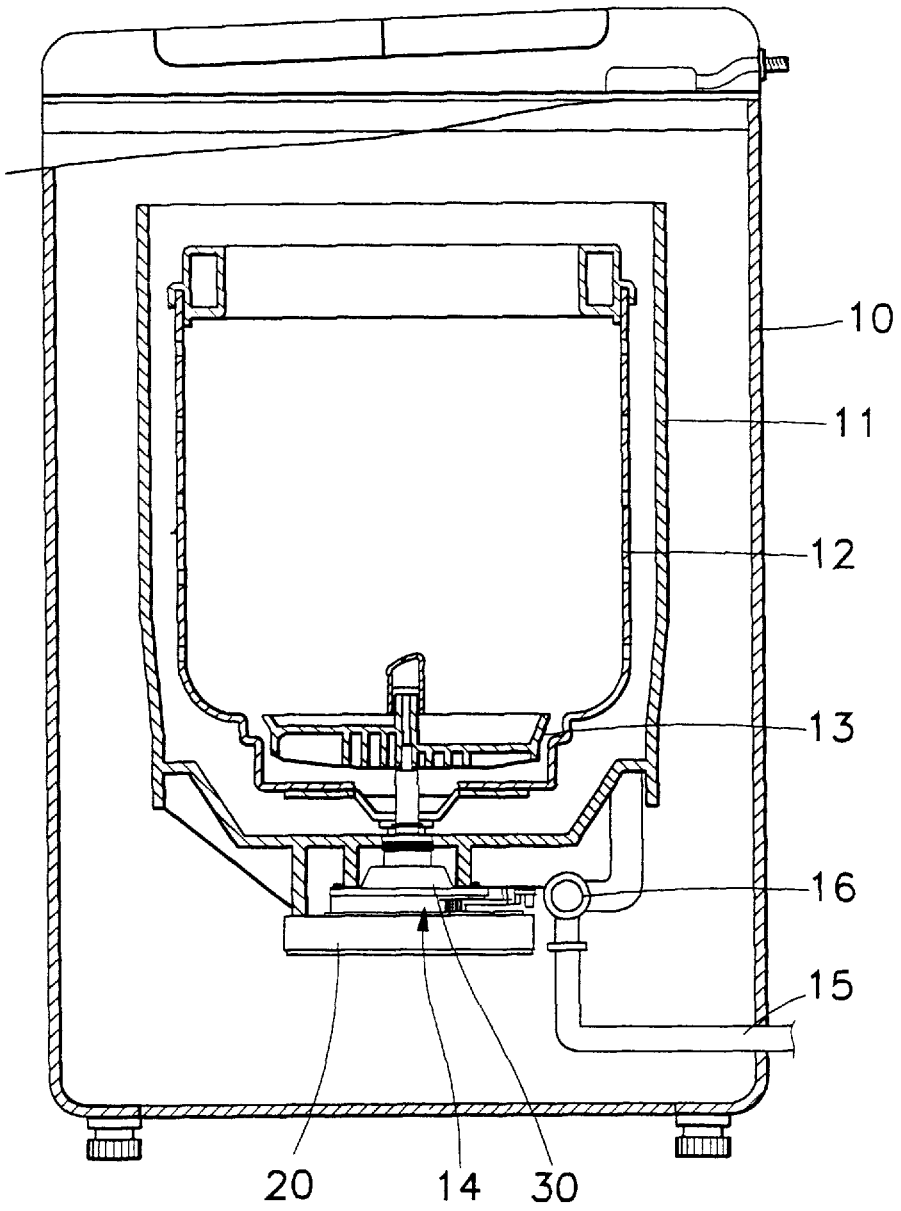
FIG. 1 is a vertical sectional view illustrating a washing machine where a power system according to the present invention is employed.

Referring first to FIG. 1, the inventive washing machine comprises a main body 10 defining an outer configuration thereof and a water tub 11 installed inside the main body 10 which holds water. A spin basket 12, inside of which laundry is washed, is provided inside the water tub 11. Installed above a bottom surface of the spin basket 12 is a pulsator 13 which oscillates in forward and reverse directions so as to generate water currents.

A power system 14, for driving the pulsator 13 and the spin basket 12, is installed under the water tub 11. Here, the power system 14 comprises a reversible motor 20 and a power transmission system 30, which transmits rotating force of the reversible motor 20 to the pulsator 13 or the spin basket 12.

In addition, a drain hose 15 is mounted to one side of the power system 14, the drain hose 15 draining the water in the water tub 11 out of the main body 10. A drain valve 16 for opening/closing the drain hose 15 is mounted on the drain hose 14. A drain motor (not shown), which controls the operation of the drain valve 16 and the power transmission system 30, is mounted between the drain valve 16 and the power transmission system 30.

Figure 2:
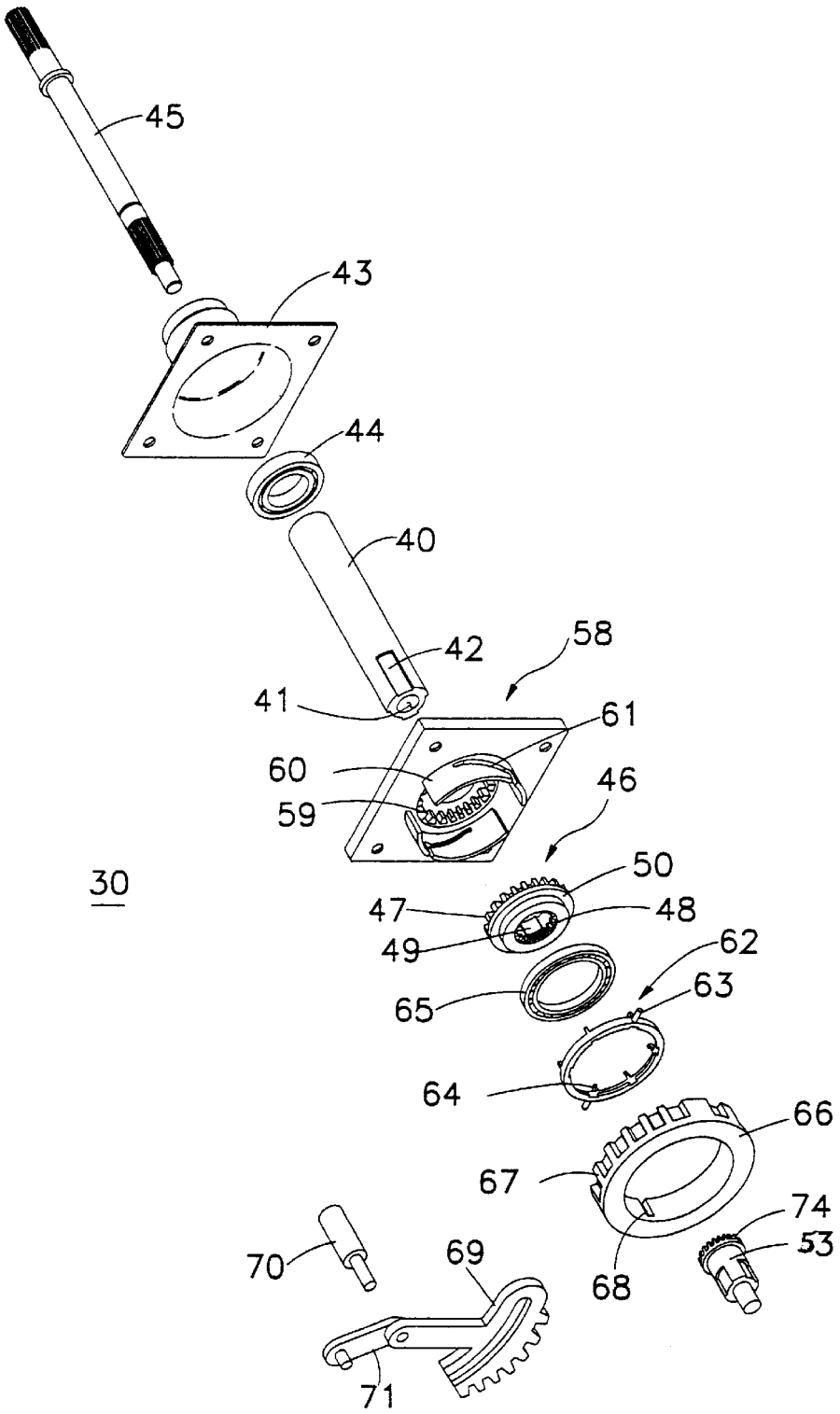
FIG. 2 is an exploded perspective view of a power system according to the preferred embodiment depicted in FIG. 1.
Figure 3:
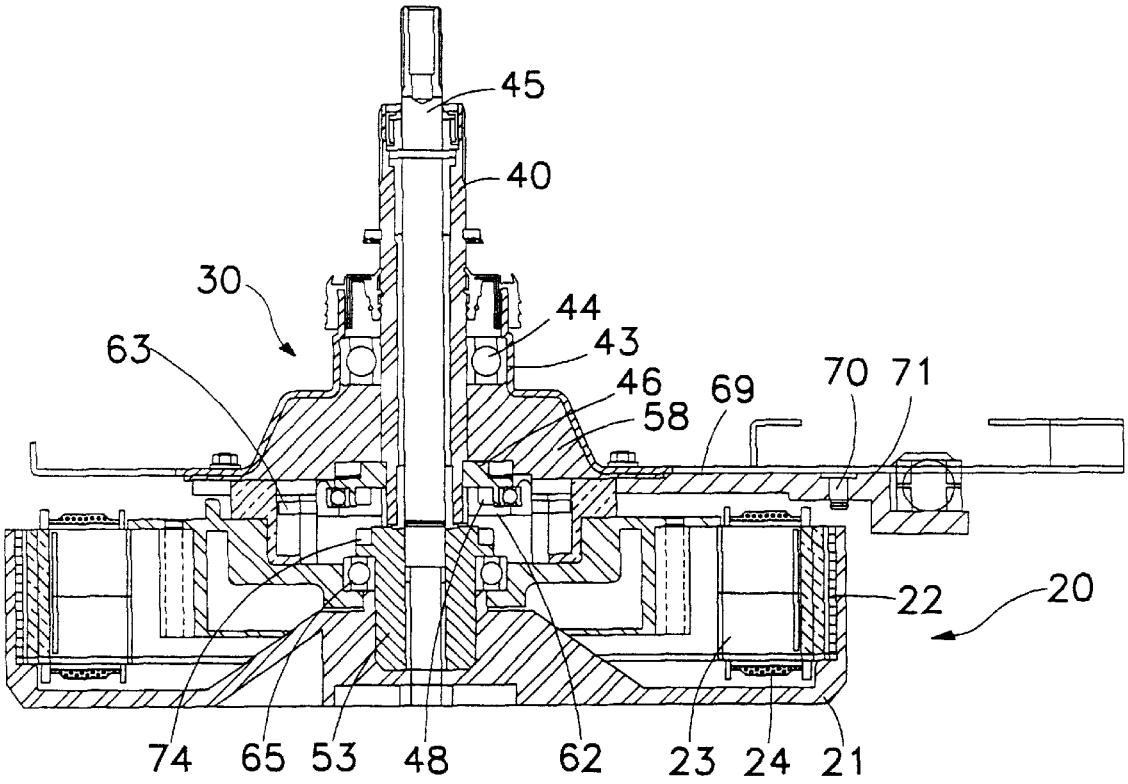
FIG. 3 is a sectional view of the power system shown in FIG. 2.

The power transmission system 30 of the power system 14 is, as shown in FIGS. 2 and 3, provided with a hollow dehydrating shaft 40 which is coupled to the spin basket after passing upwardly through a bottom wall of the water tub 11. There is further provided a cylindrical coupling plate 43 which is coupled on an inner bottom surface of the water tub 11 for supporting the dehydrating shaft 40. Here, a bearing 44 is disposed between the coupling plate 43 and the dehydrating shaft 40 so that the dehydrating shaft 40 can freely rotate.

Inserted into a hollow portion 41 of the dehydrating shaft 40 is a laundering shaft 45, an upper end of which is coupled to the pulsator 13 and a lower end of which is coupled to a rotor 21 of the reversible motor 20. Both ends of the laundering shaft 45 are serrated to allow for the coupling to the pulsator 13 and the reversible motor 20.

Inserted around the dehydrating shaft 40 is a ring-shaped connecting gear 46 which is movable vertically along the dehydrating shaft 40. After the connecting gear 46 descends along the dehydrating shaft 40, the dehydrating shaft 40 rotates together with the laundering shaft 45, and after the gear 46 ascends, only the laundering shaft 45 rotates.

That is, a coupling gear 53 which is designed to integrally rotate with the reversible motor 20 is integrally mounted on a lower end of the laundering shaft 45 so that when the connecting gear 46 descends it can mesh with the coupling gear 53.

Figure 4:
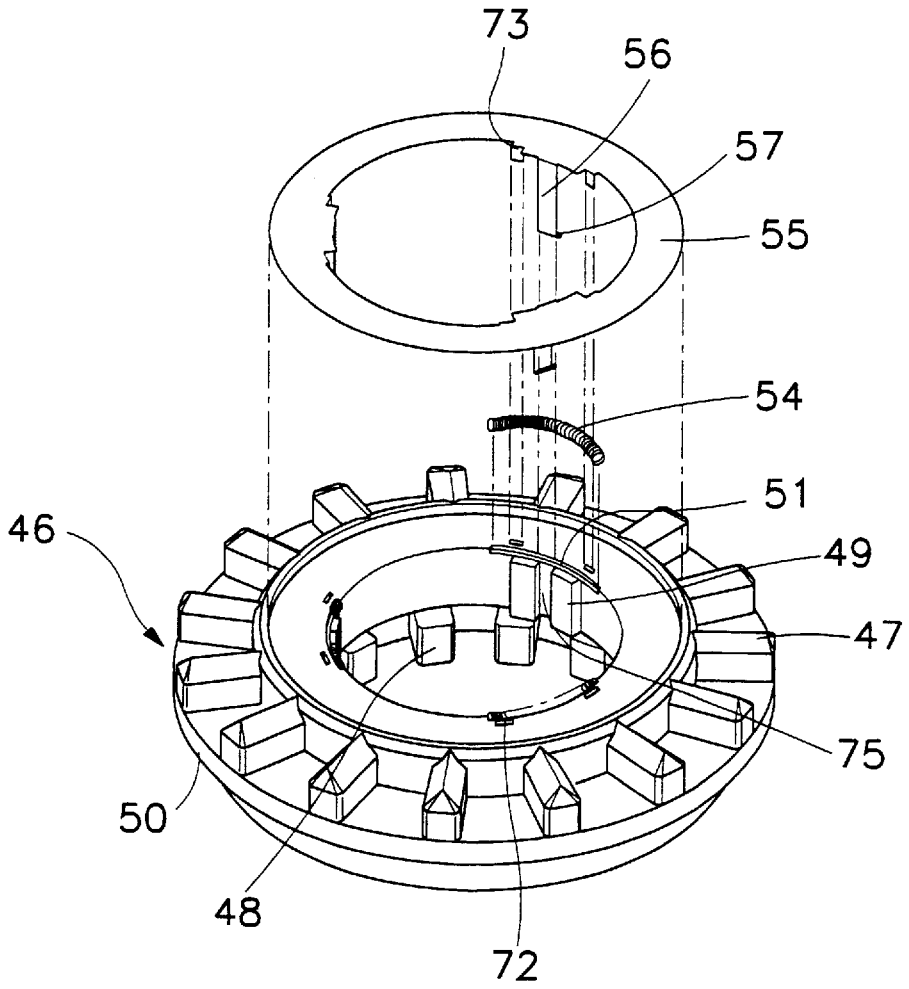
FIG. 4 is a perspective exploded view illustrating a connecting gear according to the preferred embodiment of the present invention.

The power transmission system 30 will be described more in detail in connection with the connecting gear 46 with reference to FIGS. 4, 5 and 6.

The connecting gear 46 is provided at its inner lower circumference with radially inner teeth 48, and at its outer upper circumference with radially outer teeth 47. A plurality (three) of guide projections 49 are formed above the inner teeth 48. Each guide projection 49 includes a seating groove 75 formed therein. The guide projections 49 are designed to be inserted into corresponding guide grooves 42, which extend along a portion of the dehydrating shaft 40 where the connecting gear 46 is coupled, so as to allow the connecting gear 46 to slide upward and downward within the guide grooves 42. Thus, the connecting gear 46 and the shaft 40 are interconnected for common rotation.

Each of the inner and outer teeth 48 and 47 of the connecting gear 46 has a sharp point so as to facilitate the meshing operation. However, this is not sufficient to ensure the meshing operation. Thus, each of the guide projections 49 is designed to have a smaller circumferential width than the corresponding guide groove 42 such that a predetermined circumferential clearance is defined between the guide projection 49 and the guide groove 42, thereby allowing the connecting gear 46 to be movable relative to the shaft 40 by a limited amount in the circumferential direction.

The connecting gear 46 is supposed to become meshed with one of the gear members 59 and 53 after ascending or descending along the dehydrating shaft 40. Since the engaging operation, that is, the meshing operation, is not always smoothly performed, springs 54 are provided which induce a reliable meshing operation of the connecting gear by yielding to permit the connecting gear 46 to rotate in the circumferential direction.

More in detail, each of the springs 54 is inserted into a receiving groove 51 formed in the connecting gear 46 such that both ends of the spring 51 extend circumferentially beyond its receiving groove 51. All of the springs 54 are retained by a common supporting plate 55. The supporting plate 55 is ring-shaped so that it can be coupled to an upper surface of the connecting gear 46. A plurality of downward legs 56 are formed on portions of the supporting plate 55 and each leg is seated in the seating groove 75 of a respective guide projection 49. The legs are provided at their lower ends with hook portions 57 which are hooked onto projections 52 formed on the connecting gear 46, thereby connecting the supporting plate 55 to the connecting gear 46.

The legs 56 of the supporting plate 55 extend downward and bear against middle portions of respective springs 54, to fix the springs 54 to the connecting gear 46. In addition, fixing grooves and projections 72 and 73 are formed on opposing surfaces of the connecting gear 46 and the supporting plate 55, respectively, so that the supporting plate 55 and the connecting gear 46 are further coupled to each other.

Figure 5:
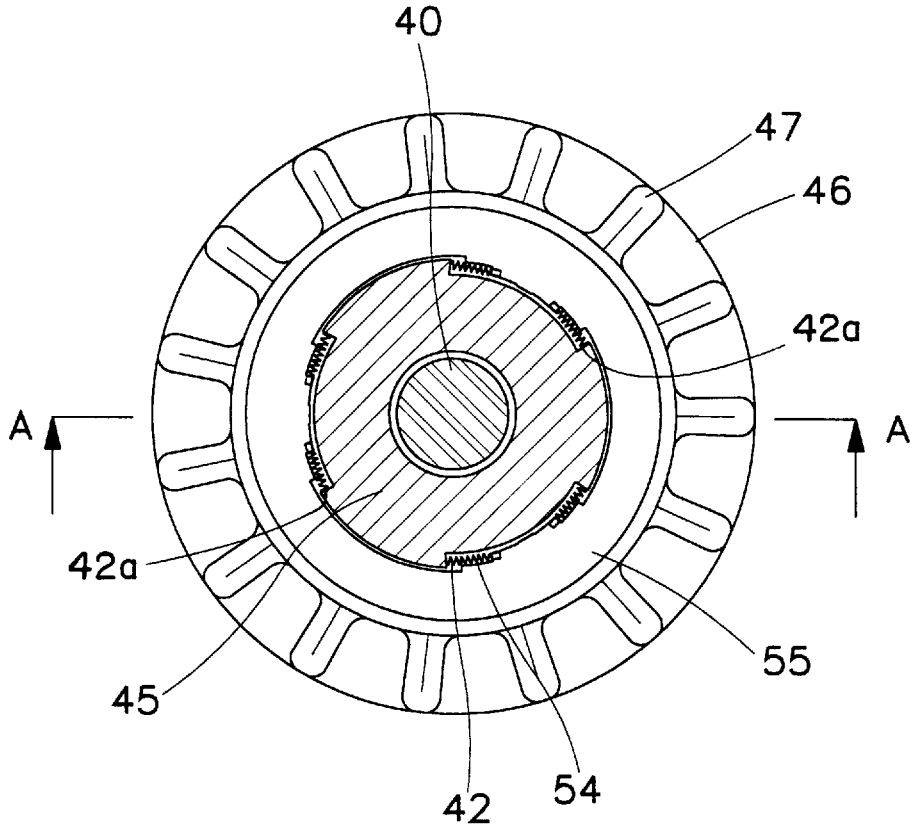
FIG. 5 is a plan view illustrating a connecting gear according to the preferred embodiment of the present invention.
Figure 6:
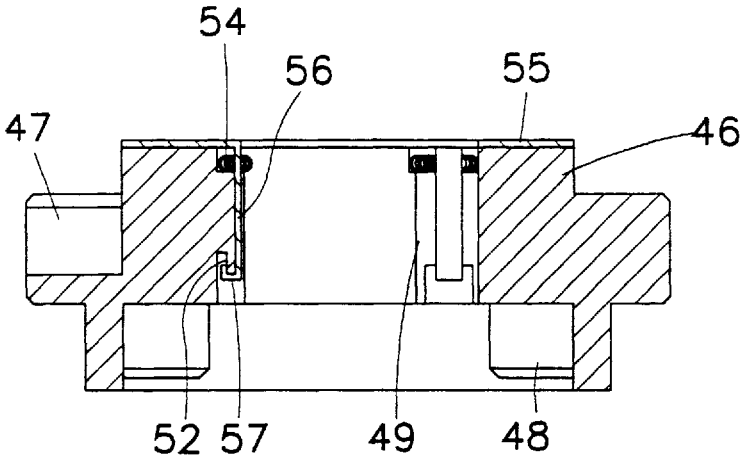
FIG. 6 is a sectional view taken along line A-A in FIG. 5.
Figure 7:
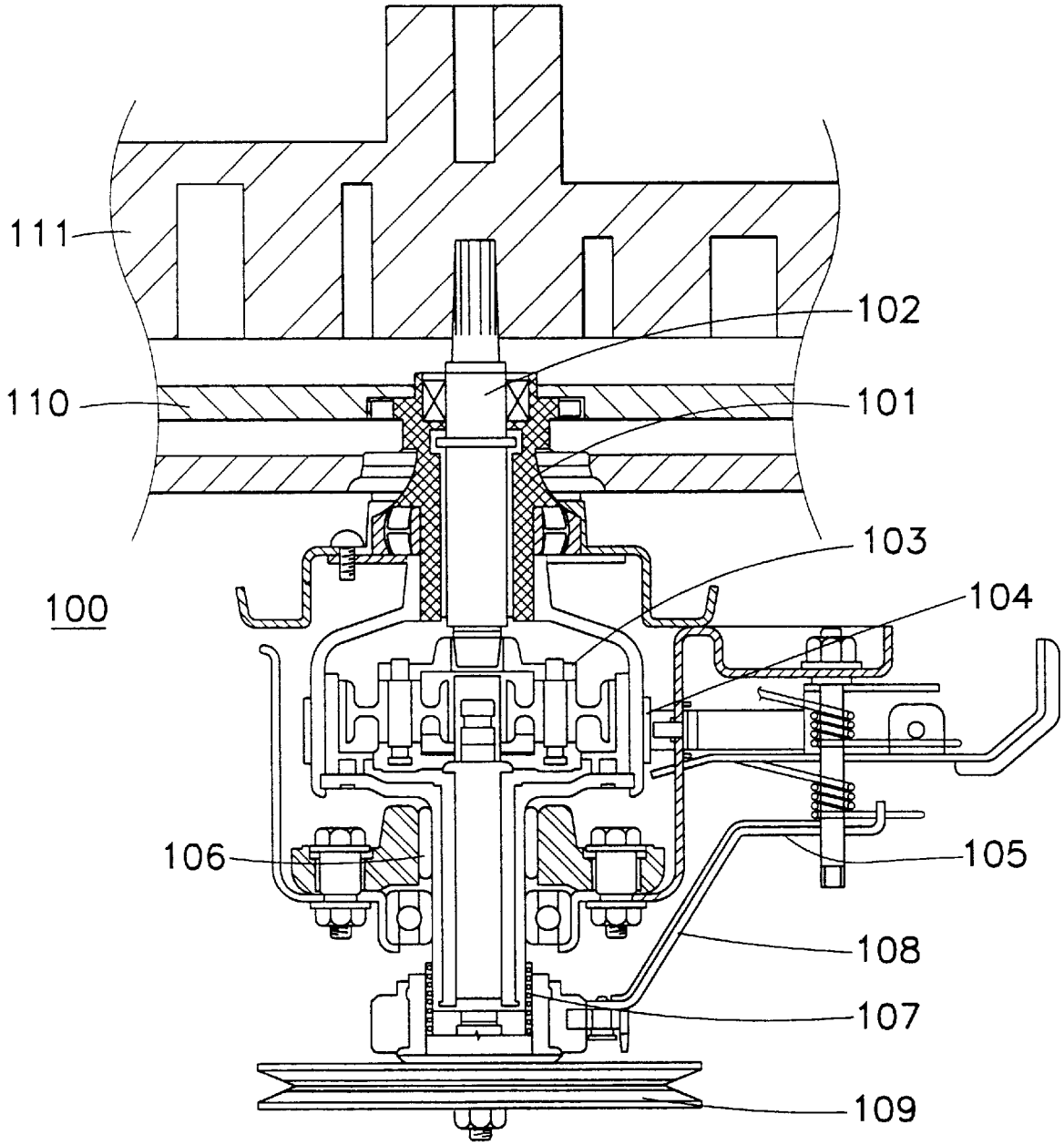
FIG. 7 (PRIOR ART)
FIG. 7 is a vertical sectional view illustrating a conventional power system.

The ends of each spring 54 engage respective circumferentially facing side walls 42*a* of an associated groove 42, as can be seen in FIG. 5 and act circumferentially between the connecting 46 and the shaft 40.

Mounted on an under surface of the water tub 11 is a fixing plate 58. The fixing plate 58 is provided with radially inner teeth 59 which, when the connecting gear 46 ascends, mesh with the outer teeth 47 of the connecting gear 46 so as to prevent rotation of the dehydrating shaft 40.

For the above operation, the connecting gear 46 should ascend and descend along the grooves 42 of the dehydrating shaft 40. Elevating means for raising and lowering the connecting gear 46 will be described more in detail hereinafter.

The elevating means comprises an elevatable guide member 60 which is coupled to the fixing plate 58 by a fastener such as bolts or screws (not shown). The guide member 60 is provided with two elevating guide slits 61.

The elevating means further comprises an elevating ring 62 on which elevating projections 79*a* associated with the elevating guide slits 61 are formed. The elevating ring 62 is engaged on a stepped portion 50 of the connecting gear 46. A bearing 65 is interposed between the connecting gear 46 and the elevating ring 62. The bearing 65 prevents rotation from being transmitted to the elevating ring 62 even when the connecting gear 46 rotates, or vice versa. The bearing 65 is designed to be fixed by a plurality of fixing steps 64 formed on upper end of the elevating ring 62.

As described above, the elevating ring 62 is designed to effect the elevating operation of the connecting gear 46 while ascending and descending along the elevating guide slits 61. For this operation, a ring-shaped elevating gear 66 is connected to free ends of the elevating projections 63.

The elevating gear 66 is provided with outer teeth 67 at an outer circumference thereof, and a pair grooves 68 corresponding to the elevating projections 63.

In addition, the outer teeth 67 of the elevating gear 66 mesh with a rotating gear 69 for rotating the elevating gear 66. A connecting bar 71 is articulated on the rotating gear 69 by a connecting pin 70. Rotating force of a drain motor (not shown) is transmitted to the connecting bar 71, thereby driving the rotating gear 69.

As shown in FIG. 3, the driving motor 20 of the power system 14 is a brushless DC motor comprised of a rotor 21 and a stator (no numerical number) disposed inside the rotor 21.

The coupling gear 53 engaged with the laundering shaft 45 of the power transmission system 30 is coupled on a central portion of the rotor 21. Magnets 22 and a coil 24 are mounted along an inner circumference of the rotor 21. The stator is comprised of a core 23 facing the magnet 22. The rotor 21 is driven by electromagnetic force generated between the core 23 of the stator and the magnet 22 of the rotor 21 by electric current applied to the coil 24.

The operation of the above described power system 14 of the washing machine according to the present invention will be described hereinafter.

Describing first a washing operation, the rotating gear 69 is rotated by the drain motor (not shown) which is driven by initial electric input current. Due to the rotation of the rotating gear 69, the elevating gear 66 rotates, making the elevating ring 62 rotate. The rotation is in a direction causing the elevating projections to ascend along the elevating guide grooves 61 of the elevating guide member 60 such that the elevating ring 62 ascends. Therefore, the connecting gear 46 ascends along the guide grooves 42 of the dehydrating shaft 40 without rotating (due to the presence of the bearing 65) so that the outer teeth 47 of the connecting gear 46 mesh with the inner teeth 59 of the fixing plate 58.

At this point, if peaks of the outer teeth 47 of the ascended connecting gear 46 do not exactly conform to valleys of the inner teeth 59 of the fixing plate 58. A force acting on each tooth of the connecting gear 46 and the fixing plate 58 acts in both an axial direction and a circumferential direction. The force acting in the circumferential direction rotates the connecting gear 46 while overcoming a biasing force of the springs 54, thereby enabling an exact engagement of the peaks with the valleys. In addition, when the peaks and valleys are exactly engaged, the springs 54 bias the guide projections 49 against the side walls 42*a* of the guide grooves 42, preventing the guide projections 49 from moving with respect to the guide grooves 42.

In the above state, after the laundry is placed in the spin basket 12 and the water is fed to the water tub 12, electric power is applied to the motor 20, whereupon the rotor 21 of the motor 20 oscillates in the forward and reverse directions. Here, the laundering shaft 45 and the coupling gear 53 rotate with the rotation of the motor 20, thereby rotating the pulsator 13 coupled to the laundering shaft 45 and performing the washing/rinsing operation.

When the washing/rinsing operation is finished, the water within the water tub 11 is drained by the opening of the drain valve 15 by the drain motor (not shown).

After the water is completely drained, the dehydrating operation is performed in a state where the drain valve 15 is opened. The operation of the power system 14 during the dehydrating cycle will be described hereinafter.

When the drain valve 15 is being opened by the drain motor, the power transmission system 30 changes to a dehydrating driving state. That is, when the drain motor is operated, the drain valve 15 is opened, and at the same time, the rotating gear 69 rotates the elevating gear 66. Due to the rotation of the elevating gear 66, the elevating projections 63 descend along the elevating guide slits 61 of the elevating guide assembly 60, thereby lowering the elevating ring 62. As a result, the connecting gear 46 descends along the guide grooves 42 of the dehydrating shaft 40. The inner teeth 48 of the descended connecting gear 46 mesh with the outer teeth 74 of the coupling gear 53.

At this point, if peaks and valleys of the inner teeth 48 of the descending connecting gear 46 do not exactly conform to corresponding valleys and peaks of the teeth 74 of the coupling gear 53, a force acts on each tooth of the connecting gear 46 and the coupling gear 53 in both an axial direction and a circumferential direction. The force acting in the circumferential direction rotates the connecting gear 46 while overcoming the biasing force of the springs 54, thereby enabling the peaks to exactly engage with the valleys. In addition, when the peaks and valleys are exactly engaged, the springs 54 bias the guide projections 49 against the side walls 42*a* of the guide grooves 42, preventing the guide projections 49 from moving with respect to the guide grooves 42.

In this state, when power is applied to the driving motor 20 so as to rotate the rotor 21 at a high speed, the laundering shaft 45 and the connecting gear 46 meshing with the coupling gear 53 also rotate at a high speed, thereby rotating the dehydrating shaft 40 at a high speed.

By this operation, the pulsator 13 and the spin basket 12 rotate at a high speed such that the water retained in the laundry is forced out by the centrifugal force and drained through the drain hose 15.

When the motor 20 stops, electrical power is applied to the motor such that a reversed magnetic flux can be generated in the coil 24 and, thus, a reversed electromagnetic force can be generated in the rotor 21. Therefore, the motor generates a reverse rotational force such that the rotating speed of the rotor 92 is rapidly reduced and consequently stopped. The operation is controlled by a control portion of the washing machine.

As described above, in the power system 14 as described above, idling rotation of the spin basket 12 is suppressed by gear engagement, and frictional noise can be reduced while suppressing the idle rotation.

In addition, since the gear meshing can be reliably performed by the springs 54, the operation of the washing machine is also reliable.

While the invention has been described in connection with what is presently considered to be most practical and preferred embodiment, it is to be understood that the invention is not limited to the disclosed embodiment, but, on the contrary, it is intended to cover various modifications and equivalent arrangements included within the spirit and scope of the appended claims.

What is claimed is:

1. A clothes washing machine, comprising:

a water tub for containing water;

a spin basket mounted inside the water tub;

a pulsator mounted in the spin basket;

a hollow dehydrating shaft having an upper end coupled to the spin basket and a lower end extending outside the water tub, the hollow dehydrating shaft having guide grooves extending longitudinally in a peripheral surface thereof;

a laundering shaft disposed coaxially within the hollow dehydrating shaft such that the laundering shaft extends out of the upper and lower ends of the hollow dehydrating shaft;

a toothed coupling gear coupled to the laundering shaft so as to rotate therewith; and a toothed connecting gear mounted on the dehydrating shaft to be ascendable/descendible along a longitudinal axis of the dehydrating shaft, the connecting gear having first teeth meshing with fixed teeth when the connecting gear is in an upper position, to prevent rotation of the spin basket; the connecting gear having second teeth meshing with teeth of the coupling gear when the connecting gear is in a lower position, to interconnect the laundering shaft and dehydrating shaft for common rotation;

a raising/lowering mechanism for raising and lowering the connecting gear between the upper and lower positions;

the connecting gear carrying guide projections slidable vertically within the guide grooves of the dehydrating shaft, a circumferential width of each guide groove being greater than a circumferential width of the associated guide projection to permit limited circumferential movement of the connecting gear relative to the dehydrating shaft for facilitating meshing of the first and second teeth of the connecting gear with the fixed teeth and the teeth of the coupling gear, respectively; and a spring arranged to act circumferentially between each guide projection and its respective guide groove and being yieldable to permit the circumferential movement of the connecting gear relative to the dehydrating shaft during the meshing of gear teeth.

2. The washing machine according to claim 1 wherein the springs are fastened to the connecting gear.

3. The washing machine according to claim 2 wherein each spring comprises a circumferentially extending coil spring.

4. The washing machine according to claim 3 further including a supporting plate attached to the connecting gear for fixing all of the springs to the connecting gear.

5. The washing machine according to claim 3 wherein each guide groove includes two longitudinally extending, circumferentially facing side walls; opposite ends of each spring engaging respective side walls of a respective guide groove.

6. The washing machine according to claim 1 further including a supporting plate attached to the connecting gear for fixing all of the springs to the connecting gear.

* * * * *